US006077059A

United States Patent [19]

Hosono

[11] Patent Number: 6,077,059

[45] Date of Patent: Jun. 20, 2000

[54] OIL PUMP ROTOR

[75] Inventor: Katsuaki Hosono, Niigata, Japan

[73] Assignee: Mitsubishi Materials Corporation, Tokyo, Japan

[21] Appl. No.: 09/044,021

[22] Filed: Mar. 19, 1998

[30] Foreign Application Priority Data

Apr. 11, 1997 [JP] Japan ..... 9-094235
Apr. 11, 1997 [JP] Japan ..... 9-094236

[51] Int. Cl.[7] ..... F03C 2/00

[52] U.S. Cl. ..... 418/150; 418/166; 418/171

[58] Field of Search ..... 418/150, 166, 418/171

[56] References Cited

U.S. PATENT DOCUMENTS 5,163,826 11/1992 Cozens ..... 418/150 X
5,226,798 7/1993 Eisenmann ..... 418/150 X
5,368,455 11/1994 Eisenmann ..... 418/150 X
5,876,193 3/1999 Hosono ..... 418/150

*Primary Examiner*—Hoang Nguyen
*Attorney, Agent, or Firm*—Oblon, Spivak, McClelland, Maier & Neustadt, P.C.

[57] ABSTRACT

An oil pump rotor in which there is formed an inner rotor 10 having n teeth, the tips of the teeth prescribed by an epicycloid curve generated by a first outer rotating circle Ei which rotates along the base circle Bi of inner rotor 10, and the tooth spaces prescribed by a hypocycloid curve generated by a first rotating circle Hi which turns along the base circle Bi of inner rotor 10, and an outer rotor 20 having n+1 teeth, the tooth spaces prescribed by an epicycloid curve generated by a second rotating circle Eo which turns along the base circle Bo of outer rotor 20 and the tips of the teeth prescribed by a hypocycloid curve generated by a second inner rotating circle Ho which rotates along the base circle Bo of outer rotor 20; wherein each of the rotors are formed to satisfy:

Do>Di, di>do where Di, di, Do, and do designate the diameters of Ei, Hi, Eo, and Ho, respectively.

5 Claims, 5 Drawing Sheets

OIL PUMP ROTOR

BACKGROUND OF THE INVENTION

1. Field of the Invention

The present invention relates to an oil pump rotor employed in an oil pump which takes in and expels a fluid according to changes in the volume of a plurality of cells which are formed between the pump's inner and outer rotors.

Conventional oil pumps are provided with an inner rotor to which n (where n is a natural number) outer teeth are formed, an outer rotor to which n+1 inner teeth are formed for engaging with the outer teeth of the inner rotor, and a casing in which an intake port for taking in fluid and an discharge port for discharging fluid are formed. In this oil pump, the inner rotor is rotated, causing the outer teeth to engage with the inner teeth, and thereby rotate the outer rotor. Fluid is taken in or expelled from a plurality of plurality of cells formed between the two rotors due to changes in the volume of the cells.

Individual cells are partitioned due to contact between the respective outer teeth of the inner rotor and the inner teeth of the outer rotor at the front and rear of the direction of rotation, and by the presence of the casing of the oil pump at either side of the inner and outer rotors. As a result, independent fluid carrier chambers are formed. Once the volume of a cell has fallen to a minimum value during the process of engagement between the outer teeth of the inner rotor and the inner teeth of the outer rotor, the cell next proceeds along an intake port where its volume is expanded, causing fluid to be taken up. After the cell's volume reaches a maximum value, the cell next proceeds along an discharge port where its volume is decreased, causing the fluid to be expelled.

Because of its small size and simple structure, an oil pump of this design has wide applications, including use as a lubricating oil pump in automobiles, an oil pump in automatic transmissions, and the like. When such oil pumps are installed in automobiles, a drive means therefore is provided by directly attaching the inner rotor to the engine's crank shaft, so that the oil pump is driven by the rotation of the engine.

In order to reduce noise generated by the pump while at the same time improve mechanical efficiency, oil pumps of the above design are provided with a suitably large tip clearance between the tips of the teeth of the inner and outer rotors at a position which is rotates by 180° from the position of engagement of the teeth in the assembly of the inner and outer rotors.

Various means may be proposed for securing the tip clearance, including providing clearance between the respective surfaces of the teeth of the rotors by carrying out uniform run-off, so that tip clearance is secured between the tips of the teeth on each of the rotors during engagement. Alternatively, tip clearance may also be secured by flattening the cycloid curve.

The oil pump disclosed in Japanese Patent Application, First Publication No. Hei 5-256268 is a so-called cycloid pump, in which the tips of the teeth of the pinion (inner rotor) and the tooth spaces of the internally toothed ring gear (outer rotor) have an epicycloid shape generated by rotating a first cycloid generating circle on the pitch circle of the pinion and the internally toothed ring gear; and the tooth spaces of the pinion and the tips of the teeth of the internally toothed ring gear have a hypocycloid shape generated by rotating a second cycloid generating ring on the pitch circle of the pinion and the internally toothed ring gear (the radius of the first cycloid generating circle is different from the radius of the second cycloid generating circle). In this oil pump, two rotating circles are used to form the tooth profile of the pinion and the internally toothed ring gear, so that the tips of the teeth of the pinion and the tooth spaces of the internally toothed ring gear are generated by the same first cycloid generating circle, and the tooth spaces of the pinion and the tips of the teeth of the internally toothed ring gear are generated by the second cycloid generating circle.

In the pump disclosed in the above reference, in order to reduce the noise generated by the pump and improve its mechanical efficiency, two cycloid curves are flattened to an extent that corresponds to the required radial clearance between the tips of the teeth in the area opposite the point where the pinion and the internally toothed ring gear engage most deeply, and so that the clearance at the point where the pinion and the internally toothed ring gear most deeply engage is significantly reduced. As a result, the pulsation of the relayed fluid is greatly reduced, and improvements are realized with respect to the noise generated by the pump, and the pump's mechanical efficiency and durability.

Incidentally, in the pump disclosed in the aforementioned reference, a closed cycloid curve is generated by connecting with a straight line the beginning and end points of a flattened cycloid curve, and the beginning and end points of an non-flattened cycloid curve on the pitch circle. However, there is the possibility that engagement between the pinion and the internally toothed ring gear will not be carried out smoothly, due to the generation of a straight line component in one portion of the cycloid curve. For example, during the process of movement of the tips of the teeth of the pinion move along the surface of the tooth spaces of the internally toothed ring gear from the position of engagement between the pinion and the internally toothed ring gear, a deflection may occur when the tips of the teeth of the pinion move from the curved line portion to the straight line portion, or from the straight line portion to the curved line portion, thus interfering with smooth progression of the engagement.

2. Description of the Related Art

The present invention was conceived in consideration of the above-described problems, and has as its objective an improvement in the mechanical efficiency and efficiency of an oil pump, by providing a suitably large interval of space between the tips of the teeth of the inner rotor and the tooth spaces of the outer rotor during the engagement of the rotors, thereby reducing the sliding resistance between the surfaces of the rotor teeth.

In order to meet the above-state objectives, in the oil pump rotor of the present invention, the inner rotor is designed such that the profile of the tips of the teeth thereof is prescribed by an epicycloid curve generated by a first outer rotating circle which circumscribes the base circle of the inner rotor and rotates without slipping along the base circle of the inner rotor, and the profile of the tooth spaces is prescribed by a hypocycloid generated by a first inner rotating circle which inscribes the base circle of the inner rotor and rotates without slipping along the base circle; and the outer rotor is designed such that the profile of the tooth spaces is prescribed by an epicycloid generated by a second outer rotating circle which circumscribes the base circle of the outer rotor and rotates without slipping along the base circle of the outer rotor, and the profile of the tips of the teeth is prescribed by a hypocycloid curve generated by a second inner rotating circle which inscribes the base circle of the outer rotor and rotates without slipping along the base circle of the outer rotor. When the diameters of the base circle, first outer rotating circle, and first inner rotating circle of the inner rotor are designated as bi, Di, and di, respectively, and the diameters of the base circle, second outer rotating circle, and second inner rotating circle of the outer rotor are designated as bo, Do, and do, and the eccentric load of the inner and outer rotors is designated as e, then the inner and outer rotors are formed to satisfy the following:

$$bi=n\cdot(Di+di),\ bo=(n+1)\cdot(Do+do)$$

$$Di+di=Do+do=2e$$

$$(n+1)\cdot bi=n\cdot bo$$

and, $$Do>Di,\ di>do$$

It is preferable to form the inner and outer rotors to satisfy the expression:

$$Di+t/2=Do,\ di-t/2=do$$

where t (where $t\neq 0$) indicates the size of the space between the tips of the teeth on the outer rotor and the tips of the teeth on the inner rotor.

It is preferable to form the inner and outer rotors of the oil pump rotor of the present invention such that:

$$0.03\text{ mm}\leqq t\leqq 0.25\text{ mm (mm: millimeter)}$$

It is preferable to form the oil pump rotor of the present invention to satisfy:

$$0.850\leqq Di/Do\leqq 0.995$$

As a condition necessary for determining the tooth profile of the inner and outer rotors, the rotating distance of the first outer rotating circle and the first inner rotating circle of the inner rotor must be closed in one circumference, i.e., must be equal to the circumference of the base circle of the inner rotor. Thus, $$bi=n\cdot(Di+di)$$

Similarly, the rotating distance of the second outer rotating circle and the second inner rotating circle of the outer rotor must be equal to the circumference of the base circle of the outer rotor. Thus, $$bo=(n+1)\cdot(Do+do)$$

Next, since the inner and outer rotors engage, $$Di+di=Do+do=2e$$

From the above equation, $$(n+1)\cdot bi=n\cdot bo$$

such that the tooth profiles of the inner and outer rotors are formed to satisfy the preceding equation.

In the oil pump rotor formed to satisfy the preceding condition, when $$Do>Di,\ di>do$$

then, it is possible for the profile of the tips of the teeth of the inner rotor, formed by the first outer rotating circle Di with respect to the profile of the tooth spaces of the outer rotor formed by the second outer rotating circle Do, and the profile of the tips of the teeth of the outer rotor, formed by the second inner rotating circle do with respect to the profile of the tooth spaces of the inner rotor formed by the first inner rotating circle di, to secure a larger backlash between the surfaces of the teeth of both rotors during engagement as compared to the conventional technologies. "Backlash" is the gap during engagement which is attainable between the tooth surface of the inner rotor which is positioned opposite the tooth surface which applies the load and the tooth surface of the outer rotor which opposes the aforementioned surface of the inner rotor.

The above relational equations must also be established in the case where the tooth profiles of each of the rotors are formed to provide tip clearance. Therefore, the necessary tip clearance t is equally divided between the rotor engagement position and the opposing position of the tips of the teeth of each of the rotors (i.e., the position where tip clearance has been provided). This will be referred to as "clearance" hereinafter. Tip clearance t is split between the tooth surfaces of the rotors at each position. This clearance can be secured by employing the following relational equations.

$$Di+t/2=Do,\ di-t/2=do$$

Two clearances (t/2) are produced at the rotor engagement position and the position of opposing tooth-tips, respectively. When the rotors are assembled, the clearance at the engagement position shifts to the position of opposing tooth-tips, so that tip clearance t is formed between opposing tooth-tips.

The inner and outer rotors of the oil pump rotor of the present invention are formed so that the profile of the tips of the teeth on the inner rotor is slightly smaller than the profile of the tooth spaces of the outer rotor, and the tooth profile of the tooth spaces of the inner rotor is slightly larger than the profile of the tips of the teeth of outer rotor. Therefore, it is possible to set the backlash and the tip clearance to be suitably large. As a result, as compared to the conventional technology, a relatively larger backlash can be secured while keeping the tip clearance small. Thus, it is difficult for a pressure pulsation to occur in the fluid, while the sliding resistance between the tooth surfaces of the rotors is reduced.

$$di-t/2=do$$

and the value of t is set to $$t=0.12\text{ mm}$$

Figure 2:
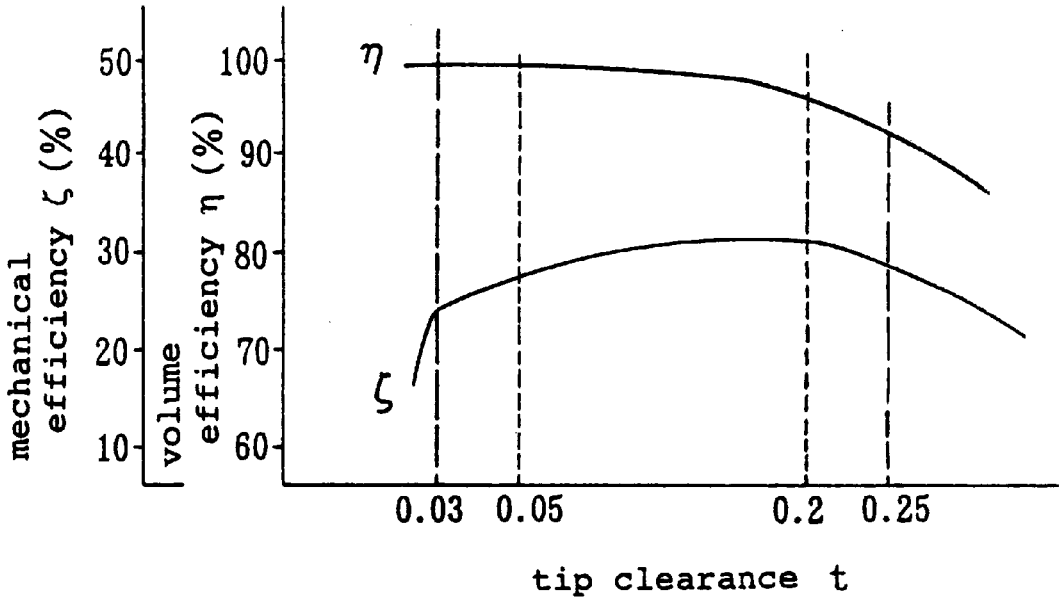

FIG. 2 is a graph showing the volume efficiency η of the pump and the mechanical efficiency ζ of the oil pump which are provided with an inner rotor and outer rotor which are formed employing an optionally selected value for t.

Figure 3:
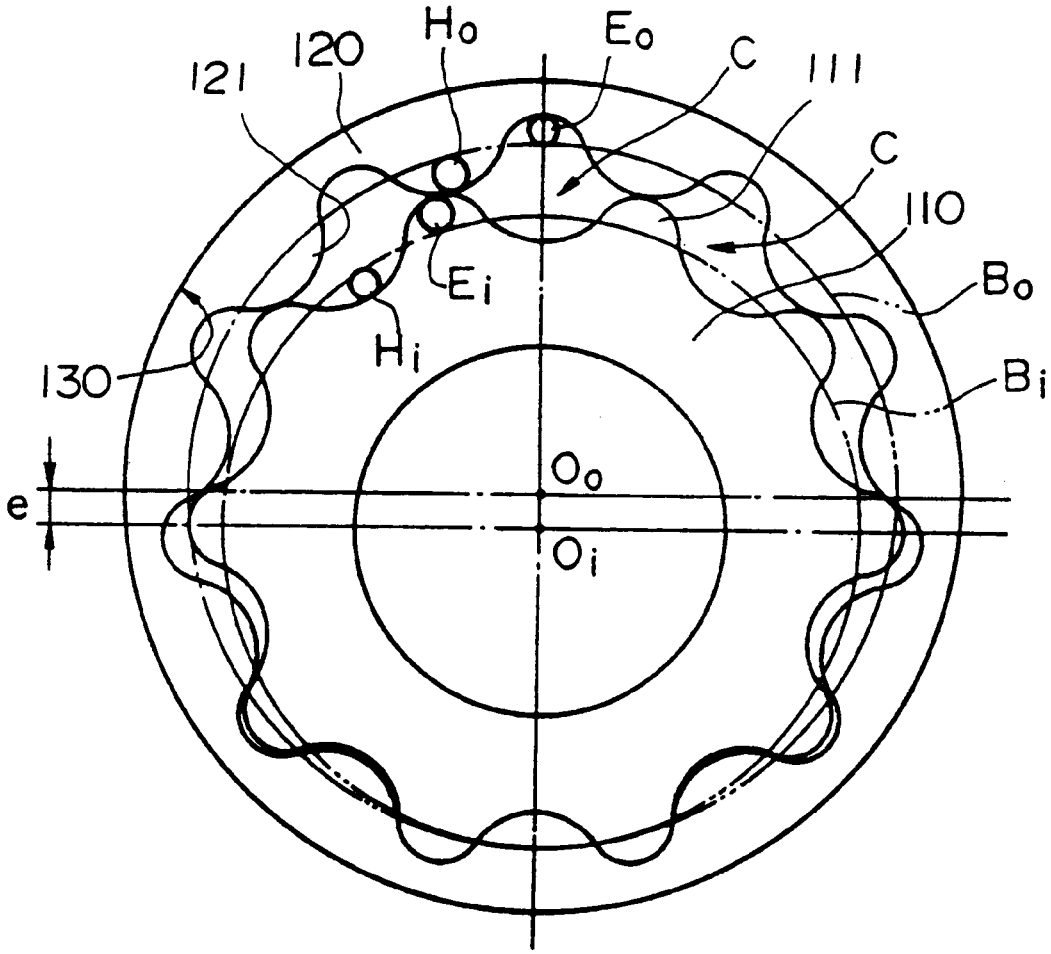

FIG. 3 shows a second embodiment of the oil pump rotor according to the present invention, wherein the oil pump is provided with an oil pump rotor in which the inner and outer rotors are formed to satisfy $$0.850\leqq Di/Do\leqq 0.995(Di/Do=0.95)$$

Figure 4:
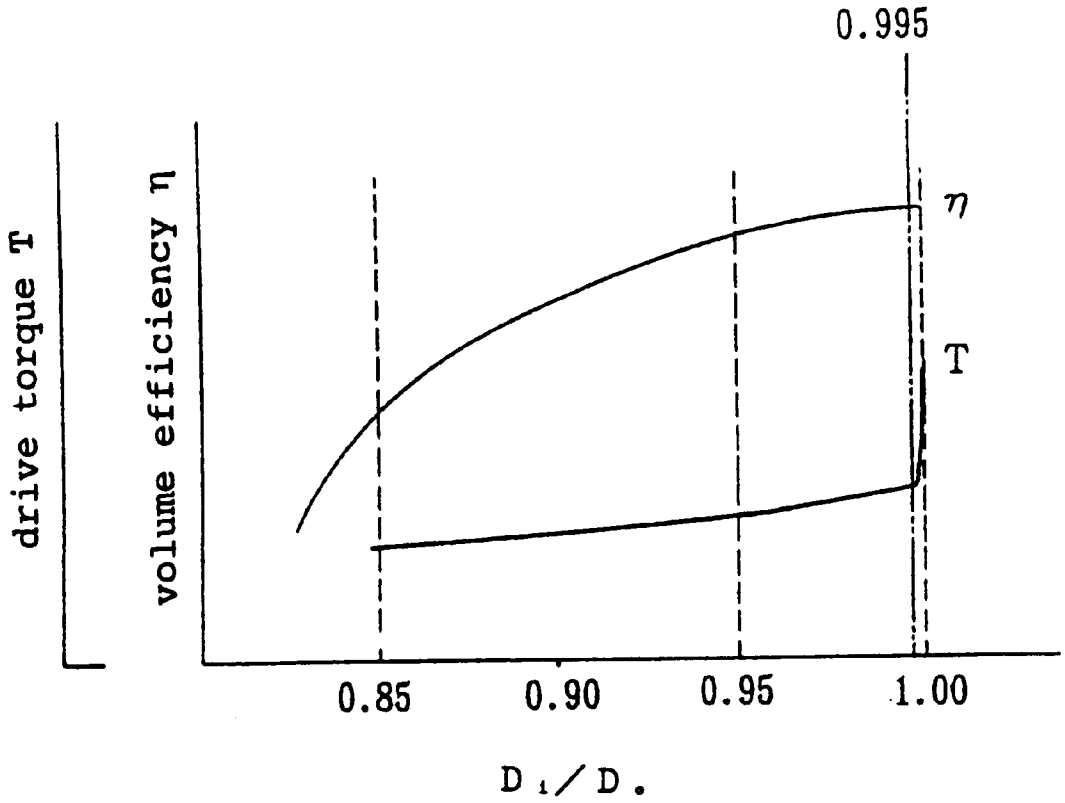

FIG. 4 is a graph showing the volume efficiency η of the pump and the drive torque T of the oil pump which is provided with inner and outer rotors which are formed employing an optionally selected value for Di/Do.

Figure 5:
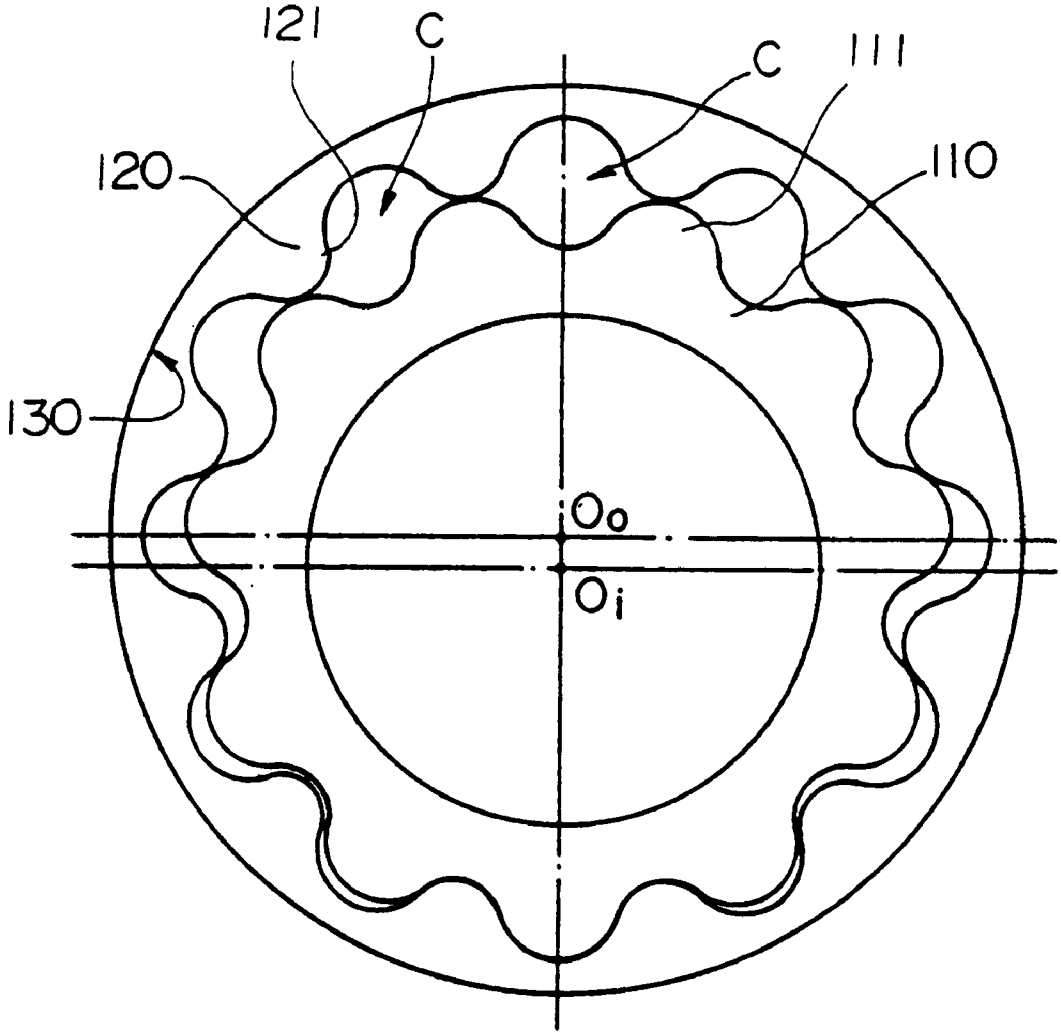

FIG. 5 shows another embodiment of an oil pump rotor according to the present invention, wherein the oil pump is provided with an oil pump rotor formed such that the inner and outer rotors satisfy $$0.850 \leqq Di/Do \leqq 0.995 (Di/Do=0.984)$$

PREFERRED EMBODIMENTS OF THE PRESENT INVENTION

A first embodiment of the oil pump rotor of the present invention will now be explained.

Figure 1:
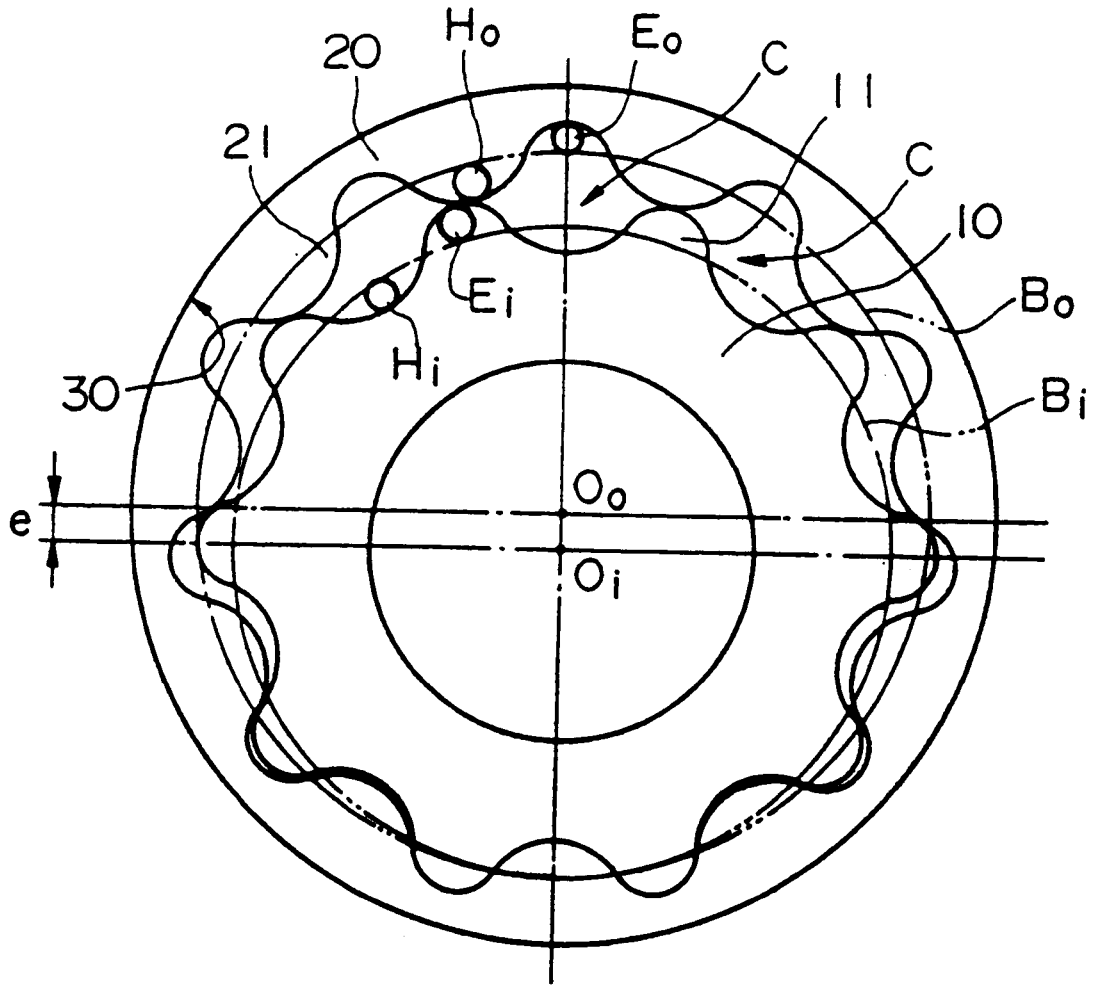
FIG. 1 shows a first embodiment of an oil pump rotor according to the present invention, wherein an oil pump is provided with an oil pump rotor in which the inner and outer rotors are formed to satisfy the relationships $$Di+t/2=\text{Do}$$

The oil pump rotor shown in FIG. 1 is provided with an inner rotor 10 to which n outer teeth are formed (wherein n is a natural number; n=10 in the present embodiment), an outer rotor 20 to which n+1 inner teeth are formed which engage with each of the outer teeth, and a casing 30 which houses inner rotor 10 and outer rotor 20 therein.

A plurality of cells C are formed in between the tooth surfaces of inner rotor 10 and outer rotor 20 along the direction of rotation of rotors 10,20. Each cell C is individually partitioned as a result of contact between respective outer teeth 11 of inner rotor 10 and inner teeth 21 of outer rotor 20 at the front and rear of the direction of rotation of the rotors 10,20 and by the presence of a casing 30 at either side of inner and outer rotors 10,20. As a result, independent fluid carrier chambers are formed. Cells C rotate and move in accordance with the rotation of rotors 10,20, with the volume of each cell C reaching a maximum and falling to a minimum level during each rotation cycle as the rotors repeatedly rotate.

Inner rotor 10 is attached to a rotating axis, and is supported to enable rotation centered about the axis center, oi. Inner rotor 10 is formed such that the profile of the tips of the teeth thereof is prescribed by an epicycloid curve generated by a first outer rotating circle Ei which circumscribes base circle Bi of inner rotor 10 and rotates without slipping along base circle Bi of inner rotor 10, and the profile of the tooth spaces thereof is prescribed by a hypocycloid curve generated by a first inner rotating circle Hi which inscribes base circle Bi of inner rotor 10 and rotates without slipping along base circle Bi.

Axis center Oo of outer rotor 20 is disposed eccentric (eccentricity: e) to axis center Oi of inner rotor 10, and is supported so as to enable rotation within casing 30 centered about axis Oo. Outer rotor 20 is formed so that the profile of the tooth spaces thereof is prescribed by an epicycloid curve generated by a second outer rotating circle Eo that circumscribes base circle Bo and rotates without slipping along base circle Bo, and the tooth profile of the tips of the teeth thereof is prescribed by a hypocycloid curve generated by a second inner rotating circle Ho which inscribes base circle Bo and rotates without slipping along base circle Bo.

When the diameters of the base circle Bi, first outer rotating circle Ei, and first inner rotating circle Hi of inner rotor 10 are designated as bi, Di, and di, respectively, and the diameters of the base circle Bo, second outer rotating circle Eo, and second inner rotating circle Ho of the outer rotor are designated as bo, Do, and do, respectively, then the following relational equations may be established for inner rotor 10 and outer rotor 20. Note that millimeters are employed as the dimensional units here.

First, the rotating distance of the first outer rotating circle Ei and the first inner rotating circle Hi of inner rotor 10 must be closed in one circumference, i.e., must be equal to the circumference of base circle Bi of the inner rotor 10. Thus, $$\pi \cdot bi = n \cdot \pi (Di+di)$$

$$\text{Namely, } bi = n \cdot (Di+di) \quad \text{(Ia)}$$

Similarly, the rotating distance of the second outer rotating circle Eo and the second inner rotating circle Ho of the outer rotor 20 must be equal to the circumference of the base circle Bo of the outer rotor. Thus, $$\pi \cdot bo = (n+1) \cdot \pi \cdot (Do+do)$$

$$\text{Namely, } bo = (n+1) \cdot (Do+do) \quad \text{(Ib)}$$

Next, since the inner and outer rotors engage, $$Di+di = Do+do = 2e \quad \text{(II)}$$

From the above equation (Ia), (Ib), and (II), the following relationship is satisfied:

$$(n+1) \cdot bi = n \cdot bo \quad \text{(III)}$$

When the space, i.e., tip clearance, provided between the tips of the teeth when the tips of outer teeth 11 and inner teeth 21 are opposite one another, at a position which is a half turn from the position of engagement between rotors 10 and 20, is defined as t, then inner rotor 10 and outer rotor 20 are formed such that:

$$Di+t/2 = Do \quad \text{(IV)}$$

$$di-t/2 = do \quad \text{(V)}$$

(Do>Di, di>do) and the value of t is set such that:

$$0.03 \text{ mm} \leqq t \leqq 0.25 \text{ mm} \quad \text{(VI)}$$

(FIG. 1 shows an inner rotor 10 and outer rotor 20 formed such that Di=2.9865 mm, di=4.6585 mm, and t=0.12 mm).

A circular intake port (not shown) is formed to casing 30 along the area in which the volume of a given cell C formed between the tooth surfaces of rotors 10,20 is increasing. Similarly, a circular discharge port (not shown) is formed along the area in which the volume of a given cell C formed between the tooth surface of rotors 10,20 is decreasing.

The present invention is designed so that after the volume of a given cell C has reached a minimum during the engagement between outer teeth 11 and inner teeth 12, fluid is taken into the cell as the cell's volume expands as it moves along the intake port. Similarly, after the volume of a given cell C has reached a maximum during engagement of outer teeth 11 and inner teeth 12, fluid is expelled from the cell as the cell's volume decreases as it moves along the discharge port.

Incidentally, by satisfying the relationships expressed in equations (IV) and (V), an oil pump rotor formed as described above has an inner rotor 10 and outer rotor 20 which are formed so that the profile of the tips of the teeth of inner rotor 10 is slightly smaller than the profile of the tooth spaces of outer rotor 20, and the profile of the tooth spaces of inner rotor 10 is slightly larger than the profile of the tips of the teeth of outer rotor 20. Therefore, it is possible to set the backlash and the tip clearance to be suitably large, and, as a result, a relatively larger backlash can be secured while keeping the tip clearance small. Thus, a fluid pressure pulsation does not occur readily, while the sliding resistance between the tooth surfaces of the rotors is reduced.

Based on the preceding then, when an inner rotor 10 and outer rotor 20 are formed wherein the value of t is set such that:

$$t<0.03 \text{ mm} \quad \text{(VII)}$$

then the tip clearance becomes too narrow. As a result, a pressure pulsation is generated in the fluid pressed out from cell C which is experiencing decreasing volume. Cavitation sounds are generated such that the operating noise of the pump becomes great. Further, the rotation of the rotors is not carried out smoothly as a result of the pressure pulsation.

Moreover, during engagement of the rotors, the gap which can be attained between the tooth surface of inner tooth 21 which is positioned opposite the tooth surface which applies the load and the tooth surface of the outer rotor which opposes the aforementioned tooth surface of the inner rotor, i.e., the backlash, is too narrow. As a result, sliding resistance is generated on tooth surfaces other than those at the position of engagement of the rotors. Thus, the drive torque so that inner rotor 10 can rotate outer rotor 20 increases, so that the mechanical efficiency of the oil pump not only drops, but the durability of the device falls due to considerable friction on the surfaces of both rotors' teeth.

In contrast, when inner rotor 10 and outer rotor 20 are formed such that the value of t satisfies:

$$t>0.25 \text{ mm} \quad \text{(VIII)}$$

then the tip clearance widens and a pressure pulsation ceases to be generated in the fluid. As a result, not only is operating noise decreased, but the backlash widens so that sliding friction decreases and mechanical efficiency improves. On the other hand, however, the liquid-tightness of individual cells C is impaired due to the larger tip clearance, leading to a deterioration in the pump efficiency and the volume efficiency in particular. Further, the drive torque is not communicated to the position of true engagement. Thus, rotation loss becomes great, causing the mechanical efficiency to fall.

FIG. 2 is a graph showing the value of t, and the relationship between the pump's mechanical efficiency $\zeta$ and the volume efficiency $\eta$. According to this graph, the volume efficiency $\eta$ is stable at a high level within the range which satisfies the above equation (VII), however, mechanical efficiency $\zeta$ becomes extremely low value as t becomes smaller. Further, within the range which satisfies equation (VIII), both mechanical efficiency $\zeta$ and volume efficiency $\eta$ become lower as t becomes larger. From the graph it may also be understood that an even more optimal value of t is included within the range which satisfies $$0.05 \text{ mm} \leqq t \leqq 0.20 \text{ mm}$$

with the most optimal value for t being around 0.12.

Accordingly, as may be understood from the graph, by forming an inner rotor 10 and outer rotor 20 which satisfy the above equation (VI), the backlash and tip clearance can be set to suitably large sizes, with the backlash secured at a larger size while maintaining the tip clearance at a smaller size, as compared to the conventional technologies. Moreover, since a pressure pulsation is not readily generated in the fluid, and the sliding resistance between the teeth surfaces of both rotors is reduced, the operating noise of the pump can be held to a low level. Further, the thus-formed oil pump has high volume efficiency, excellent pump efficiency, a small drive torque, and superior mechanical efficiency.

A second preferred embodiment of an oil pump rotor according to the present invention will now be explained with reference to the figures.

The oil pump shown in FIG. 3 is provided with an inner rotor 110 to which m (where m is a natural number, 10 in this embodiment) outer teeth 111 are formed, and an outer rotor 120 to which m+1 inner teeth 121 are formed for engaging with the outer teeth of the inner rotor. Inner rotor 110 and outer rotor 120 are housed in a casing 130.

As in embodiment 1, when the eccentricity of axis center Oo of outer rotor 120 with respect to axis center Oi of inner rotor 110 is designated as e, the diameters of the base circle Bi, first outer rotating circle Ei, and first inner rotating circle Hi of inner rotor 110 are designated as bi, Di, and di, respectively, and the diameters of the base circle Bo, second outer rotating circle Eo, and second inner rotating circle Ho of outer rotor 120 are designated as bo, Do, and do, respectively, then the following relational equations may be established for inner rotor 110 and outer rotor 120.

First, for inner rotor 110:

$$bi=m\cdot(Di+di) \quad \text{(IXa)}$$

Similarly, for outer rotor 120:

$$bo=(m+1)\cdot(Do+do) \quad \text{(IXb)}$$

Next, since the inner and outer rotors engage, $$Di+di=Do+do=2e \quad \text{(X)}$$

From equations (IXa), (IXb), and (X), $$(m+1)\cdot bi=m\cdot bo \quad \text{(XI)}$$

Inner rotor 110 and outer rotor 120 are formed such that the value of the ratio of diameter Di of first outer rotating circle Ei to diameter Do of second outer rotating circle Eo is within the range $$0.850 \leqq Di/Do \leqq 0.995 \quad \text{(XII)}$$

(FIG. 4 shows an inner rotor 110 and outer rotor 120 formed such that Di/Do is 0.95.

Taking into consideration the engagement relationship between the two rotors in the thus-formed oil pump rotor, the profile of the tooth-tips of inner rotor 110 is designed to be larger than the profile of the tooth spaces of outer rotor 120, i.e., the profile of the tooth-tips of inner rotor 110 is designed so that the value of Di/Do does not exceed 1, but rather has a value which is smaller than 1.

Thus, drawing on this fact, when inner rotor 110 and outer rotor 120 are formed so that $$Di/Do>0.995 \quad \text{(XIII)}$$

then the interval of space between the tips of the teeth on inner rotor 110 and outer rotor 120, i.e., the tip clearance, becomes too narrow. As a result, a pressure pulsation is generated in the fluid pressed out from cell C which is experiencing decreasing volume. Cavitation sounds are generated, such that the pump's operational noise becomes great. Further, the rotation of both motors is not carried out smoothly due to the pressure pulsation of the fluid.

Moreover, during engagement of the rotors, the gap which can be attained between the tooth surface of inner tooth 121 which is positioned opposite the tooth surface which applies the load and the tooth surface of the outer rotor which opposes the aforementioned tooth surface of the inner rotor, i.e., the backlash, is too narrow. As a result, sliding resistance is generated on tooth surfaces other than those at the position of engagement of the rotors. Thus, the drive torque required so that inner rotor 110 can rotate outer rotor 120 increases. Thus, the mechanical efficiency of the oil pump not only falls, but the durability of the device decreases due to considerable friction between the tooth surfaces of the rotors.

In contrast, when inner rotor 110 and outer rotor 120 are formed such that:

$$Di/Do<0.850 \quad \text{(XIV)}$$

then the tip clearance widens and a pressure pulsation ceases to be generated in the fluid. As a result, not only is the operating noise of the pump decreased, but backlash is widened so that sliding resistance decreases and mechanical efficiency improves. On the other hand, however, the liquid-tightness of individual cells C is impaired due to the wider tip clearance, leading to a deterioration in pump efficiency and the volume efficiency in particular.

FIG. 4 is a graph showing the relationship between Di/Do, the drive torque T necessary for rotating the rotor, and the pump's volume efficiency η. As may be understood from the graph, volume efficiency η is stabilized at a high level within the range which satisfies the above equation (XIII), however, drive torque T rises rapidly as the value of Di/Do becomes larger. Further, within the range which satisfies equation (XIV), drive torque T is stabilized at a low level, but the volume efficiency η become lower as Di/Do becomes smaller.

From the graph it may also be understood that an even more optimal value of Di/Do is included within the range which satisfies $$0.95 \leqq Di/Do \leqq 0.99$$

with the most optimal value for Di/Do being around 0.95.

Accordingly, as may be understood from the graph, by forming an inner rotor 110 and outer rotor 120 which satisfy the above equation (XII), the backlash and tip clearance can be set suitably large, with the backlash maintained at a larger size while maintaining the tip clearance at a smaller size, as compared to the conventional technologies. Moreover, since a pressure pulsation is not readily generated in the fluid, and the sliding resistance between the teeth surfaces of both rotors is reduced, the operating noise of the pump can be held to a low level. Further, the thus-formed oil pump has high volume efficiency, excellent pump efficiency, a small drive torque, and superior mechanical efficiency.

FIG. 5 shows an oil pump provided with an inner rotor 110 and outer rotor 120 formed such that the value of Di/Do is 0.984(where tooth number m of inner rotor 110 is 11). The tip clearance and backlash are set to be small in this oil pump rotor. As may be understood from the graph in FIG. 5, greater emphasis has been placed on improving volume efficiency than on reducing the drive torque in this oil pump. Thus, it is preferable to select the value of Di/Do after sufficiently considering the characteristics required of the oil pump.

What is claimed:

1. An oil pump rotor provided with an inner rotor to which n outer teeth are formed, where n is a natural number, an outer rotor to which n+1 inner teeth are formed which engage with each of the outer teeth, and a casing in which an intake port for taking in fluid and an discharge port for discharging fluid are formed, the oil pump rotor employed in an oil pump which relays fluid by taking up or discharging the fluid according to changes in the volume of a plurality of cells formed between the tooth surfaces of the two rotors when the rotors are engaged and rotated, wherein:

the inner rotor is designed such that the profile of the tips of the teeth thereof is prescribed by an epicycloid curve generated by a first outer rotating circle which circumscribes the base circle of the inner rotor and rotates without slipping along the base circle of the inner rotor, and the profile of the tooth spaces is prescribed by a hypocycloid generated by a first inner rotating circle which inscribes the base circle of the inner rotor and rotates without slipping along the base circle of the inner rotor;

the outer rotor is designed such that the profile of the tooth spaces is prescribed by an epicycloid generated by a second outer rotating circle which circumscribes the base circle of the outer rotor and rotates without slipping along the base circle of the outer rotor, and the profile of the tips of the teeth is prescribed by a hypocycloid curve generated by a second inner rotating circle which inscribes the base circle of the outer rotor and rotates without slipping along the base circle of the outer rotor; and the inner and outer rotors are formed to satisfy:

$$bi=n\cdot(Di+di),\ bo=(n+1)\cdot(Do+do)$$

$$Di+di=Do+do=2e$$

$$(n+1)\cdot bi=n\cdot bo$$

and, $$Do>Di,\ di>do$$

where bi, Di, and di indicate the diameters of the base circle, first outer rotating circle, and first inner rotating circle of the inner rotor, respectively, bo, Do, and do designate the diameters of the base circle, second outer rotating circle, and second inner rotating circle of the outer rotor, respectively, and e indicates the eccentric load of the inner and outer rotors.

2. An oil pump rotor according to claim 1, wherein the inner and outer rotors are formed to satisfy the expression:

$$Di+t/2=Do,\ di-t/2=do$$

where t (t≠0) indicates the size of the space between the tips of the teeth on the inner rotor and the tips of the teeth on the outer rotor.

3. An oil pump rotor according to claim 1, wherein the inner rotor and the outer rotor are formed to satisfy:

$$0.850 \leqq Di/Do \leqq 0.995.$$

4. An oil pump rotor according to claim 2, wherein the inner rotor and the outer rotor are formed to satisfy:

$$0.03\ \text{mm} \leqq t \leqq 0.25\ \text{mm (mm: millimeter).}$$

5. An oil pump rotor according to claim 2, wherein the inner rotor and the outer rotor are formed to satisfy:

$$0.850 \leqq Di/Do \leqq 0.995.$$

* * * * *